US005964060A

United States Patent [19]

Furlong

[11] Patent Number: 5,964,060

[45] Date of Patent: Oct. 12, 1999

[54] DOOR WITH MOVABLE LOWER BLOCK

[76] Inventor: Gregory S. Furlong, P.O. Box 3288, Wrightwood, Calif. 92397

[21] Appl. No.: 09/190,568

[22] Filed: Nov. 12, 1998

[51] Int. Cl.[6] ..... E06B 7/28

[52] U.S. Cl. ..... 49/320

[58] Field of Search ..... 49/316, 319, 320

[56] References Cited

U.S. PATENT DOCUMENTS

| | | | |
|---|---|---|---|
| 2,541,421 | 2/1951 | Hunter | 49/316 X |
| 3,059,287 | 10/1962 | Baruch et al. | 49/319 X |
| 5,339,881 | 8/1994 | Owens | 49/316 X |

FOREIGN PATENT DOCUMENTS

| | | | |
|---|---|---|---|
| 95878 | 12/1983 | European Pat. Off. | 49/316 |
| 1683704 | 6/1979 | Germany | 49/316 |

*Primary Examiner*—Jerry Redman

[57] ABSTRACT

A door locking and sealing system is provided including a doorway having a floor, a wall mounted on the floor with a rectangular cut out formed therein, and a recess formed in the floor along a lower edge of the cut out. Also included is a door housing having an outer face, an inner face and a thin peripheral side wall integrally coupled therebetween for defining a hollow interior space. The peripheral side wall is defined by a top face, an inboard side face hingably coupled within the cut out of the wall, an outboard side face and an open bottom. A block is slidably situated within the open bottom of the door housing. Finally, a control assembly is provided for raising and lowering the block in and out of the recess.

8 Claims, 4 Drawing Sheets

DOOR WITH MOVABLE LOWER BLOCK

BACKGROUND OF THE INVENTION

1. Field of the Invention

The present invention relates to door seals and more particularly pertains to a new door with movable lower block for locking a door and sealing an associated doorway.

2. Description of the Prior Art

The use of door seals is known in the prior art. More specifically, door seals heretofore devised and utilized are known to consist basically of familiar, expected and obvious structural configurations, notwithstanding the myriad of designs encompassed by the crowded prior art which have been developed for the fulfillment of countless objectives and requirements.

Known prior art door seals and the like include U.S. Pat. Nos. 4,805,948; 4,519,165; 4,073,093; 4,805,345; 5,056,836; and U.S. Pat. No. Des. 332,666.

In these respects, the door with movable lower block according to the present invention substantially departs from the conventional concepts and designs of the prior art, and in so doing provides an apparatus primarily developed for the purpose of locking a door and sealing a doorway.

SUMMARY OF THE INVENTION

In view of the foregoing disadvantages inherent in the known types of door seals now present in the prior art, the present invention provides a new door with movable lower block construction wherein the same can be utilized for locking a door and sealing a doorway.

The general purpose of the present invention, which will be described subsequently in greater detail, is to provide a new door with movable lower block apparatus and method which has many of the advantages of the door seals mentioned heretofore and many novel features that result in a new door with movable lower block which is not anticipated, rendered obvious, suggested, or even implied by any of the prior art door seals, either alone or in any combination thereof.

To attain this, the present invention generally comprises a doorway having a floor and a wall mounted on the floor with a rectangular cut out formed therein. A rectangular recess is formed in the floor along a lower edge of the cut out, as shown in FIG. 1. Next provided is a door housing including an outer face, an inner face and a thin peripheral side wall integrally coupled therebetween. As such, a hollow interior space is defined. The peripheral side wall is formed of a top face, an inboard side face hingably coupled within the cut out of the wall, an outboard side face and an open bottom. FIG. 1 shows a rubber block having a rectangular configuration with a large inner face, a large outer face and a thin periphery formed therebetween. The rubber block is slidably situated within the open bottom of the door housing. Also included is a control assembly for raising and lowering the rubber block. As shown in FIG. 4, the control assembly may include an elongated worm screw rotatably coupled within the interior space of the door housing between the side faces of the peripheral side wall. A motor is mounted within the interior space of the door housing above the elongated worm screw. Attached to the motor and an end of the elongated worm screw is a pair of pulleys with a belt or chain coupling the same. As such, the elongated worm screw rotates in a first direction during the actuation of the motor with a first polarity. Further, the worm screw rotates in a second direction during the actuation of the motor with a second polarity.

A plurality of gears are rotatably coupled between the inner face and outer face of the door housing. Such gears are spacedly engaged with the elongated worm screw for rotating coincidentally therewith. With reference still to FIG. 4, pulleys of the control assembly are shown to be mounted on each of the gears with a cable attached thereto. Such cable is in turn attached to a top face of the rubber block for raising the block into the door housing during the actuation of the motor with the first polarity. The gears are further adapted to lower the block into the recess of the door during the actuation of the motor with the second polarity. A dead bolt is provided including a shaft slidably situated within the outboard side face of the door housing. Associated therewith is a rotating member mounted on the inner face of the door housing. The rotating member serves for transferring the shaft to a locked orientation inserted into a bore formed in the doorway. The rotating member may further be transferred to an unlocked orientation retracted within the door housing. A switch is situated adjacent the shaft and connected to the motor for actuating the motor with the first polarity when the shaft is in the unlocked orientation. The switch further functions for actuating the motor with the second polarity when the shaft is in the locked orientation. Mounted on the inner face of the door housing is a keypad which is also connected to the motor. In use, the keypad serves to actuate the motor with the first polarity upon the entry of a first predetermined code. Further, the keypad actuates the motor with the second polarity when a second predetermined code is entered. Finally, a battery is situated within the door housing for powering the motor. The battery is connected to a port mounted on the inner face of the door housing. The port is adapted to releasably receive a plug connected to a power source for recharging purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door with movable lower block apparatus and method which has many of the advantages of the door seals mentioned heretofore and many novel features that result in a new door with movable lower block which is not anticipated, rendered obvious, suggested, or even implied by any of the prior art door seals, either alone or in any combination thereof.

It is another object of the present invention to provide a new door with movable lower block which may be easily and efficiently manufactured and marketed.

It is a further object of the present invention to provide a new door with movable lower block which is of a durable and reliable construction.

An even further object of the present invention is to provide a new door with movable lower block which is susceptible of a low cost of manufacture with regard to both materials and labor, and which accordingly is then susceptible of low prices of sale to the consuming public, thereby making such door with movable lower block economically available to the buying public.

Still yet another object of the present invention is to provide a new door with movable lower block which provides in the apparatuses and methods of the prior art some of the advantages thereof, while simultaneously overcoming some of the disadvantages normally associated therewith.

Still another object of the present invention is to provide a new door with movable lower block for locking a door and sealing a doorway.

Even still another object of the present invention is to provide a new door with movable lower block that includes a doorway having a floor, a wall mounted on the floor with a rectangular cut out formed therein, and a recess formed in the floor along a lower edge of the cut out. Also included is a door housing having an outer face, an inner face and a thin peripheral side wall integrally coupled therebetween for defining a hollow interior space. The peripheral side wall is defined by a top face, an inboard side face hingably coupled within the cut out of the wall, an outboard side face and an open bottom. A block is slidably situated within the open bottom of the door housing. Finally, a control assembly is provided for raising and lowering the block in and out of the recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
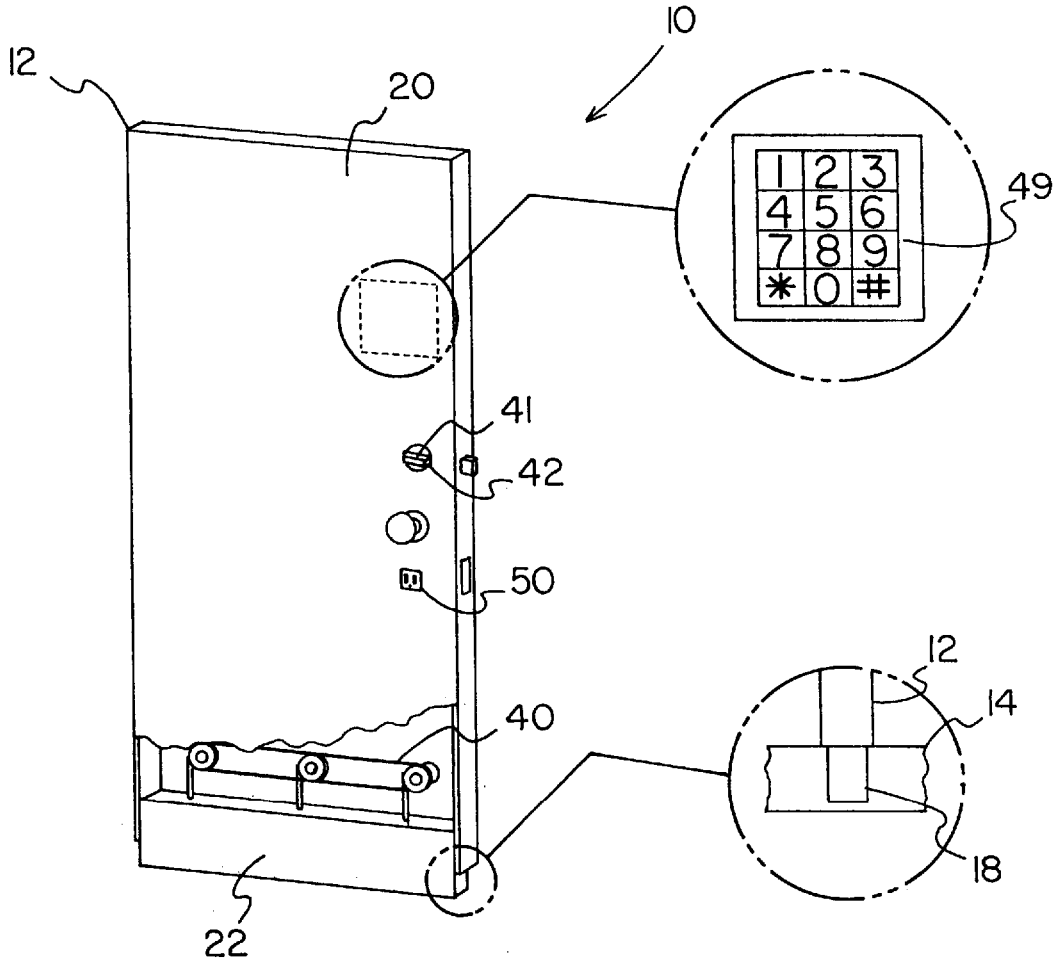
FIG. 1 is a front view of a new door with movable lower block according to the present invention.

With reference now to the drawings, and in particular to FIGS. 1 through 5 thereof, a new door with movable lower block embodying the principles and concepts of the present invention and generally designated by the reference numeral 10 will be described.

The present invention, designated as numeral 10, includes a doorway 12 having a floor 14 and a wall mounted on the floor with a rectangular cut out formed therein. A rectangular recess 18 is formed in the floor along a lower edge of the cut out and in coplanar relationship with the wall, as shown in FIG. 1.

Next provided is a door housing 20 including an outer face, an inner face and a thin peripheral side wall integrally coupled therebetween. As such, a hollow interior space is defined. The peripheral side wall is formed of a top face, an inboard side face hingably coupled within the cut out of the wall, an outboard side face and an open bottom.

FIG. 1 shows a rubber block 22 having a rectangular configuration with a large inner face, a large outer face and a thin periphery formed therebetween. The rubber block is slidably situated within the open bottom of the door housing. As shown in FIG. 1, the block preferably has a height of at least ⅛ that of the door housing.

Figure 4:
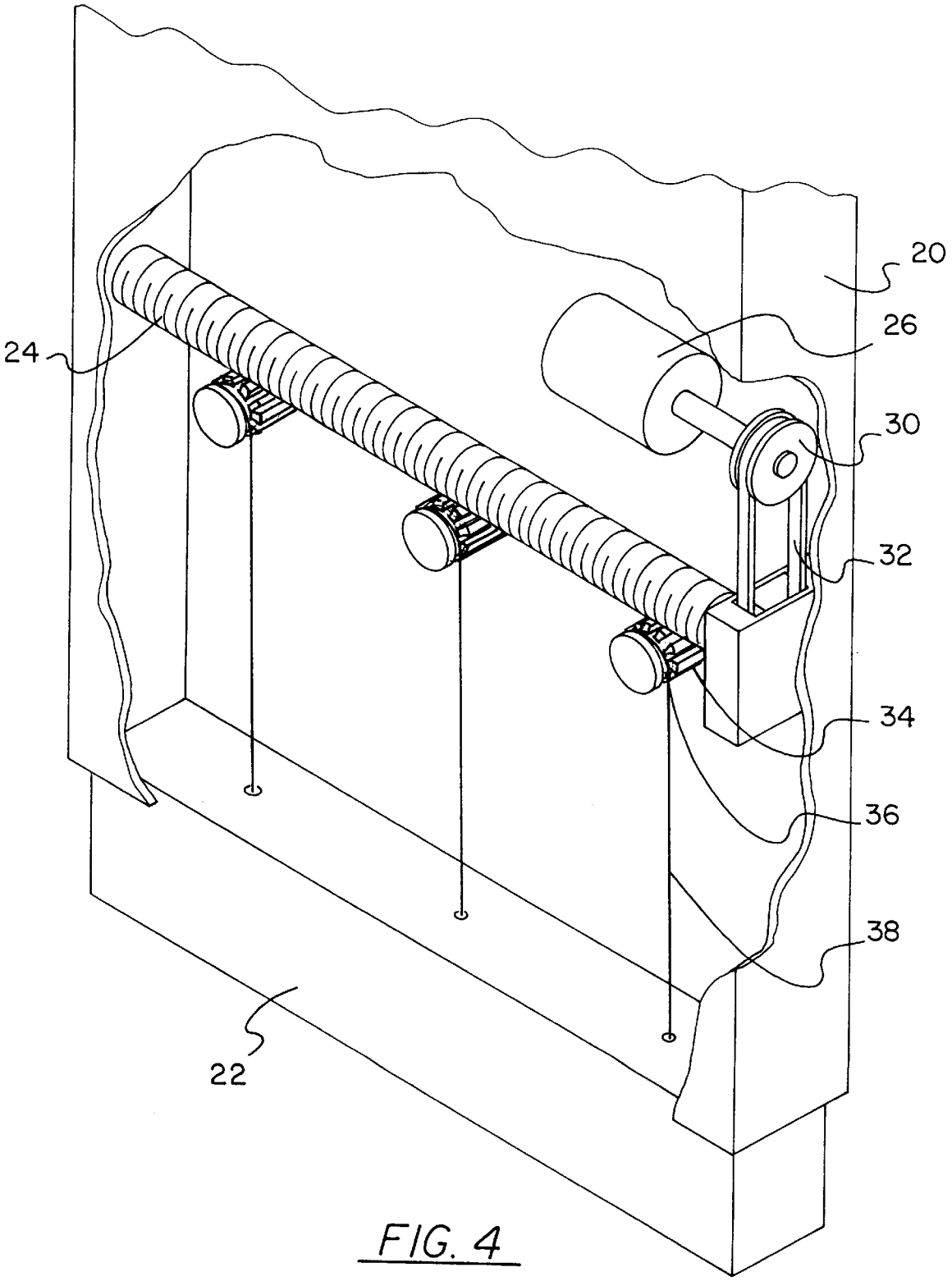
FIG. 4 is a front view of another embodiment of the control assembly of the present invention.

Also included is a control assembly for raising and lowering the rubber block. As shown in FIG. 4, the control assembly may include an elongated worm screw 24 rotatably coupled within the interior space of the door housing between the side faces of the peripheral side wall. A motor 26 is mounted within the interior space of the door housing above the elongated worm screw. Attached to the motor and an end of the elongated worm screw 28 is a pair of gears or pulleys 30 with a belt 32, chain, or gear coupling the same. As such, the elongated worm screw rotates in a first direction during the actuation of the motor with a first polarity. Further, the worm screw rotates in a second direction during the actuation of the motor with a second polarity. A plurality of disk-shaped gears 34 are rotatably coupled between the inner face and outer face of the door housing. Such gears are spacedly engaged with the elongated worm screw for rotating coincidentally therewith.

With reference still to FIG. 4, pulleys or O-rings 36 of the control assembly are shown to be mounted on each of the gears with a cable, belt or chain 38 attached thereto. Ideally, bearings are employed to allow the gears 34 and pulleys 36 to rotate coincidentally with respect to the door. Each cable is in turn attached to a top face of the rubber block via a nut or screw for raising the block into the door housing during the actuation of the motor with the first polarity. The gears 34 are further adapted to lower the block into the recess of the door during the actuation of the motor with the second polarity.

Figure 2:
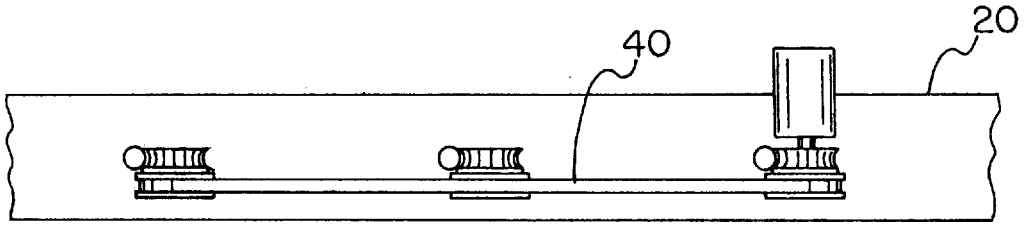
FIG. 2 is a top view of a first embodiment of the control assembly of the present invention shown in FIG. 1.

In another embodiment, as shown in FIGS. 1 & 2, the control assembly may include just a belt or chain 40 connecting each of the pulleys that are associated with the gears in the previous embodiment. In the present embodiment, one of the pulleys may be directly powered by the motor. It should be noted that the control assembly may include any form of means for accomplishing the foregoing task including, but not limited to, hydraulics, magnets, and the like.

A dead bolt 41 is provided including a shaft slidably situated within the outboard side face of the door housing.

Figure 5:
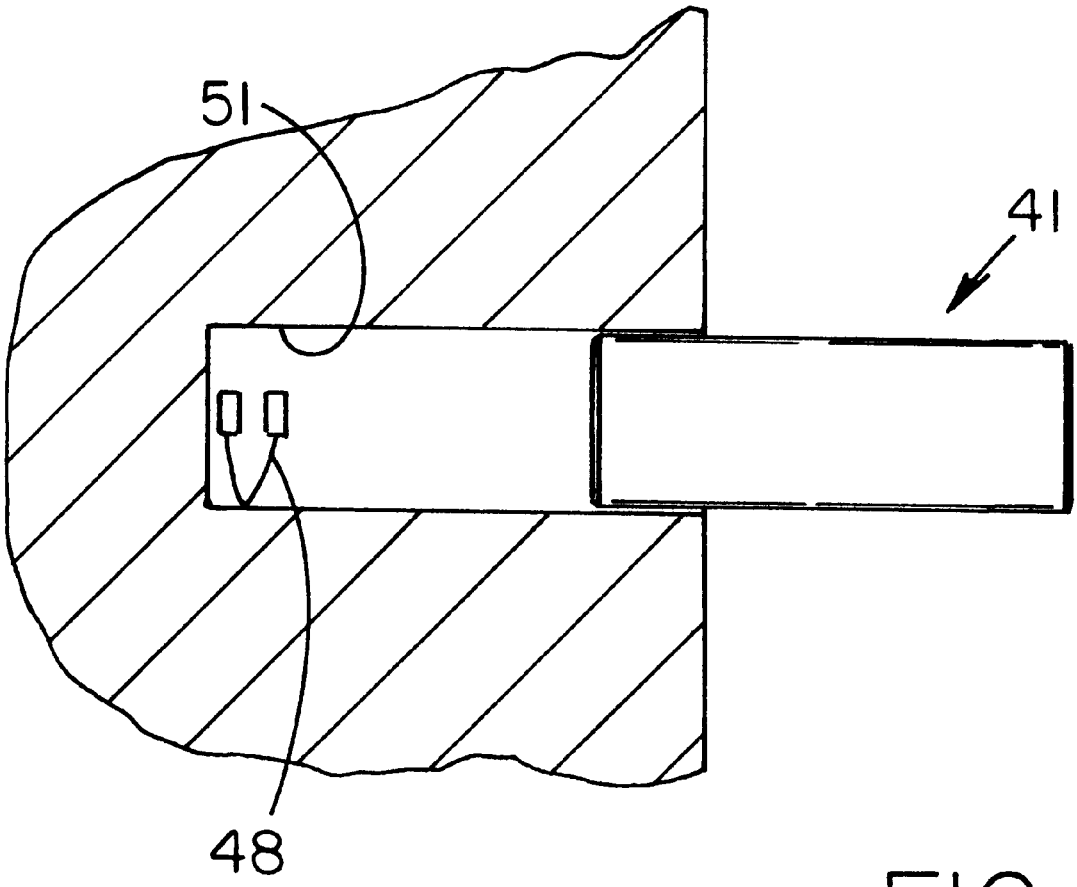
FIG. 5 is a cross-sectional view of the deadbolt chamber showing the V-shaped switch therein.

Associated therewith is a rotating member 42 mounted on the inner face of the door housing. The rotating member serves for transferring the shaft to a locked orientation inserted into a bore formed in the doorway. The rotating member may further be transferred to an unlocked orientation retracted within the door housing. It should be noted that a key actuated locking mechanism may be mounted on the outer face of the door housing for performing the function of the aforementioned rotating member. The dead bolt has a V-shaped switch 48 that is situated adjacent the shaft and connected to the motor for actuating the motor with the first polarity when the shaft is in the unlocked orientation. The switch further functions for actuating the motor with the second polarity when the shaft is in the locked orientation. As shown in FIG. 5, the switch has a pair of resilient members with inboard ends that are connected to an interior end of a deadbolt chamber 51 in which the shaft resides. Outboard ends of the switch are maintained out of contact when the shaft is extended from the chamber in the locked orientation and closed when inserted within the chamber in the unlocked orientation.

Also mounted on the inner face of the door housing is an optional keypad 49 which is also connected to the motor. In use, the keypad serves to actuate the motor with the first polarity upon the entry of a first predetermined code. Further, the keypad actuates the motor with the second polarity when a second predetermined code is entered.

Finally, an unillustrated battery is situated within the door housing for powering the motor. The battery is connected to a port 50 mounted on the inner face of the door housing. The port is adapted to releasably receive a plug connected to a power source for recharging purposes. In the preferred embodiment, the battery serves as merely a back-up power supply and the primary source of power is an alternating current source. The motor is ideally connected to such alternating current source by way of a wire that is situated through the hingable coupling of the door housing.

Figure 3:
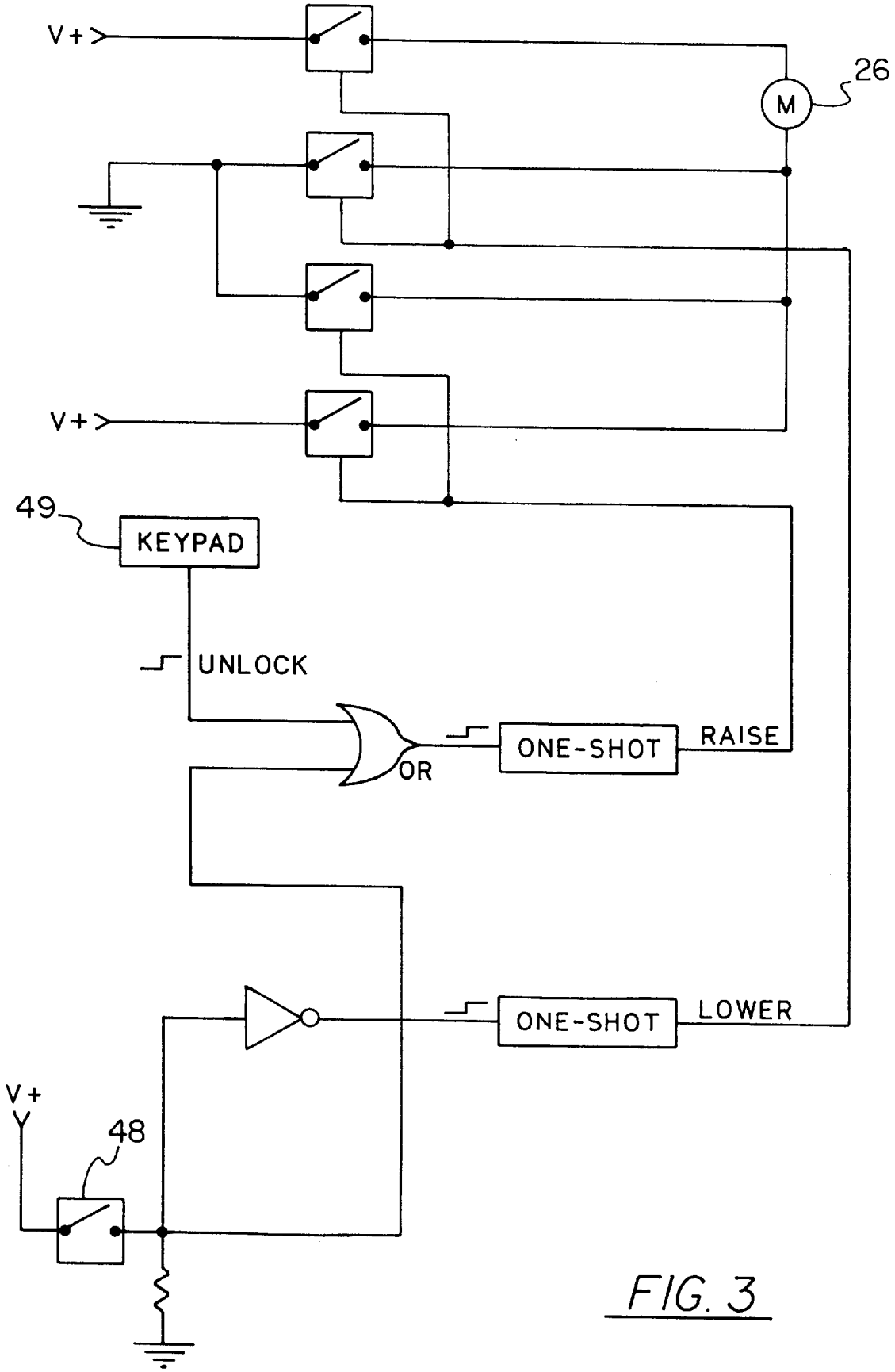
FIG. 3 is a schematic diagram of the present invention.

The means by which the keypad and dead bolt control the motor is shown in FIG. 3. As shown, a pair of one-shot multivibrators are employed to actuate the motors for the appropriate duration. An OR gate is used to allow the control of the multivibrators by either the key pad or dead bolt switch. It should be understood that while the keypad is shown to be capable of only raising the rubber block in the schematic of FIG. 3, another OR gate may be included to allow the keypad to lower the rubber block. Further, as an option, other entities such as a door bell, garage door opener, or car door light switch may be employed to govern the control assembly. A plurality of voltage controlled switches are configured as specifically shown in FIG. 3 in order to deliver the appropriate polarity to the motor.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door locking and sealing system comprising, in combination:

a doorway including a floor, a rectangular recess formed in the floor;

a door housing including an outer face, an inner face and a thin peripheral side wall integrally coupled therebetween for defining a hollow interior space, the peripheral side wall defined by a top face, an inboard side face hingably coupled within the cut out of the wall, an outboard side face and an open bottom;

a rubber block having a rectangular configuration with a large inner face, a large outer face and a thin periphery formed therebetween, the rubber block being slidably situated within the open bottom of the door housing;

a control assembly including an elongated worm screw rotatably coupled between the side faces of the peripheral side wall of the door housing within the interior space thereof and above the rubber block, a motor mounted within the interior space of the door housing above the elongated worm screw, a pair of pulleys attached to the motor and an end of the elongated worm screw with a belt coupling the same such that the elongated worm screw rotates in a first direction during the actuation of the motor with a first polarity and in a second direction during the actuation of the motor with a second polarity, a plurality of gears rotatably coupled between the inner face and outer face of the door housing and spacedly engaged with the elongated worm screw for rotating coincidentally therewith, and a pulley mounted on each of the gears with a cable attached thereto which in turn is attached to a top face of the rubber block for raising the block into the door housing during the actuation of the motor with the first polarity and lowering the block into the recess of the floor during the actuation of the motor with the second polarity;

a dead bolt including a shaft slidably situated within the outboard side face of the door housing, a rotating member mounted on the inner face of the door for transferring the shaft between a locked orientation inserted into a bore formed in the doorway and an unlocked orientation retracted within the door housing, and a switch connected to the motor for actuating the motor with the first polarity when the shaft is in the unlocked orientation and further actuating the motor with the second polarity when the shaft is in the locked orientation;

a keypad mounted on the inner face of the door housing and connected to the motor, the keypad adapted to actuate the motor with the first polarity upon the entry of a first predetermined code and further actuate the motor with the second polarity when a second predetermined code is entered; and a battery situated within the door housing for powering the motor, the battery connected to a port mounted on the inner face of the door housing which is adapted to releasably receive a plug connected to a power source for recharging purposes.

2. A door locking and sealing system comprising:

a doorway including a floor, and a recess formed in the floor;

a door housing including an outer face, an inner face and a thin peripheral side wall integrally coupled therebetween for defining a hollow interior space, the peripheral side wall defined by a top face, an inboard side face hingably coupled within the cut out of the wall, an outboard side face and an open bottom;

a block slidably situated within the open bottom of the door housing;

a control assembly for raising and lowering the block in and out of the recess; and wherein the control assembly includes a motor.

3. A door locking and sealing system as set forth in claim 2 and further including a switch for effecting the raising and lowering of the block by the control assembly.

4. A door locking and sealing system as set forth in claim 3 wherein the switch is connected to a lock mounted on the outboard side face of the door.

5. A door locking and sealing system as set forth in claim 2 and further including a battery for powering purposes, wherein a port is mounted on the door for releasably connecting to an outside power source for recharging purposes.

6. A door locking and sealing system as set forth in claim 2 wherein the control assembly includes a worm screw and a plurality of disk-shaped gears.

7. A door locking and sealing system as set forth in claim 2 wherein the control assembly includes a plurality of pulleys and a belt.

8. A door locking and sealing system comprising:

a doorway including a floor, and a recess formed in the floor;

a door housing including an outer face, an inner face and a thin peripheral side wall integrally coupled therebetween for defining a hollow interior space, the peripheral side wall defined by a top face, an inboard side face hingably coupled within the cut out of the wall, an outboard side face and an open bottom;

a block slidably situated within the open bottom of the door housing;

a control assembly for raising and lowering the block in and out of the recess; and wherein the control assembly includes a motor;

a switch for effecting the raising and lowering of the block by the control assembly;

wherein the switch is connected to a lock mounted on the outboard side face of the door;

a battery for powering purposes, wherein a port is mounted on the door for releasably connecting to an outside power source for recharging purposes;

wherein the control assembly includes a worm screw and a plurality of disk-shaped gears; and wherein the control assembly includes a plurality of pulleys and a belt.

* * * * *